US005913409A

United States Patent [19]

Test

[11] Patent Number: 5,913,409

[45] Date of Patent: Jun. 22, 1999

[54] SPORTSMAN'S VEST

[76] Inventor: Pete B. Test, 344 Clancy St., Helena, Mont. 59601

[21] Appl. No.: 09/014,324

[22] Filed: Jan. 27, 1998

[51] Int. Cl.[6] ..... A41D 1/04

[52] U.S. Cl. ..... 2/102; 2/94

[58] Field of Search ..... 2/102, 94, 69, 2/108, 93, 85

[56] References Cited

U.S. PATENT DOCUMENTS

| | | | |
|---|---|---|---|
| 2,272,041 | 2/1942 | Pocock | 2/94 |
| 2,485,442 | 10/1949 | Halliday | 2/94 |
| 2,620,479 | 12/1952 | Buck | 2/94 |
| 2,678,447 | 5/1954 | Bracken | 2/94 |
| 5,014,359 | 5/1991 | Hanson | 2/94 |
| 5,075,900 | 12/1991 | Chittenden | 2/94 |
| 5,127,565 | 7/1992 | Grant | 2/94 X |
| 5,247,707 | 9/1993 | Parker et al. | 2/102 |
| 5,265,782 | 11/1993 | McNamara | 2/94 X |
| 5,617,582 | 4/1997 | Burwell | 2/102 |

*Primary Examiner*—Gloria Hale

[57] ABSTRACT

A sportsman's vest includes a singular t-shaped piece divided into a back panel, a left side/front panel, and a right side/front panel. The back panel includes a top portion, a middle portion and a bottom portion. The middle portion and the bottom portion of the back panel are lined with liquid impervious material. A plurality of three mesh pockets are provided, being located one each on the left side/front panel, the right side/front panel, and the back panel. A plurality of three outer pockets are provided, which outer pockets attach one each to the plurality of three mesh pockets providing for a double pocket design. Large shell attachments are provided. Pocket flaps are provided. An inner back pocket is provided in the back panel. One half each of an adjustable securing strap is located respectively one each on the left side/front panel and the right side/front panel. Adjustable suspenders adjustable straps are provided. The bottom bottle pocket is open therethrough on a horizontal plane across the bottom portion of the back panel. The bottom bottle pocket has a left open end and a right open end, which open ends each have a drawstring assembly.

10 Claims, 4 Drawing Sheets

SPORTSMAN'S VEST

BACKGROUND OF THE INVENTION

1. Field of the Invention

The present invention relates to sports persons garments and more particularly to a sportsman's vest particularly adapted for wear by shooters needing readily access to ammunition as well as easily accessible storage for game, live birds for dog training, empty shot shells and other accouterments such as drinking bottle, lunch bag, first aid kit, jacket, gloves, etc.

2. Description of the Prior Art

The use of hunting garments and other sports persons vests are known in the prior art. More specifically, hunting garments heretofore devised and utilized for the purpose of supporting a variety of articles used by shooters are known to consist basically of familiar, expected and obvious structural configurations, notwithstanding the myriad of designs encompassed by the prior art which have been developed for the fulfillment of countless objectives and requirements.

A variety of prior art devices have been devised to be worn by shooters or hunters or other sports persons to support articles used while shooting or hunting.

By way of example, note U.S. Pat. No. 1,520,962 to North directed to a protective garment, U.S. Pat. No. 2,436,430 to Hart directed to a two purpose body garment, U.S. Pat. No. 3,744,059 to Hayes directed to a tennis ball pocket, U.S. Pat. No. 3,885,248 to Salsby directed to a hunting vest, U.S. Pat. No. 4,241,459 to Quayle directed to a vest for photographers, U.S. Pat. No. 4,637,075 to Ingrisano et al. directed to an emergency medical services system, U.S. Pat. No. 4,669,127 to Swanson directed to a pack vest, U.S. Pat. No. 4,949,401 to Kimsey, Jr. directed to a collapsible multi compartmented pack for the back of a garment, U.S. Pat. No. 5,014,359 to Hanson directed to a vest and backpack combination, U.S. Pat. No. 5,127,565 to Grant directed to an ammunition dispensing garment, U.S. Pat. No. 5,247,707 to Parker et al. directed to a utility vest with an integrally carried pack, U.S. Pat. No. 5,465,425 to Crispin directed to a fishing garment with removable pockets with fastening means on both pocket sides, and U.S. Pat. No. 5,487,190 to Thompson directed to a workman's material support vest for supporting cylinders.

In this respect, the sportsman's vest according to the present invention substantially departs from the conventional concepts and designs of the prior art, and in doing so provides a sportsman's vest primarily developed for the purpose of providing ready access to ammunition as well as easily accessible storage for game, live birds for dog training, empty shot shells and other accouterments such as drinking bottle, lunch bag, first aid kit, jacket, gloves, etc. In addition, the sportsman's vest according to the present invention substantially departs from the conventional concepts and designs of the prior art by providing a game carrying area which allows the game to cool and a liquid impervious material to protect the wearer's back and pants.

Therefore, it can be appreciated that there exists a continuing need for new and improved sportsman's vests which can be used by shooters or other sports persons to maintain their accouterments in convenient proximity. In this regard, the present invention substantially fulfills this need.

SUMMARY OF THE INVENTION

In view of the foregoing disadvantages inherent in the known types of hunting and other sports persons vests now present in the prior art, the present invention provides an improved construction. As such, the general purpose of the present invention, which will be described subsequently in greater detail, is to provide a new and improved sportsman's vest which has all of the advantages of the prior art and none of the disadvantages.

To attain this, the new and improved sportsman's vest of the present invention comprises a sportsman's vest particularly adapted for wear by hunters, shooters, dog trainers, or the like, and is designed and adapted to wrap around and be secured upon the upper torso of the wearer. The sportsman's vest provides for an inner side and an outer side when the same is being worn. The sportsman's vest includes, in combination, a singular t-shaped piece which is divided into a back panel, a left side/front panel, and a right side/front panel (which left and right side/front panels are relative to the front of the wearer when the sportsman's vest is worn). The back panel includes a top portion, a middle portion and a bottom portion. The bottom portion of the back panel is folded and secured to provide a bottom bottle pocket. The singular t-shaped piece may be crafted from any sturdy, flexible material, but 1000 Denier Cordura "Reg. U.S.Pat.&Tm.Off." or similar strength material provide optimal results. The middle portion and the bottom portion of the back panel are lined on the outer side with material which provides for liquid imperviousness.

A plurality of three mesh pockets are provided, said mesh being either knitted mesh material or woven mesh material. A first mesh pocket is located on the outer side of the left side/front panel and is attached on two sides and the bottom of left side/front panel and has a top opening. A second mesh pocket is located on the outer side of the right side/front panel and is attached on two sides and the bottom of right side/front panel and has a top opening. In an alternative embodiment, said first mesh pocket and said second mesh pocket may be made of non-mesh sturdy material.

A third mesh pocket is located on the outer side of the back panel and attaches on the bottom to bottom bottle pocket and on the top to top portion. The bottom of third mesh pocket provides for a mesh top of bottom bottle pocket. The third mesh pocket has a pair of top openings, one each on each side of the attachment of the third mesh pocket to the top portion, which top openings provide for easy access into said third mesh pocket. The third mesh pocket has a plurality of four reinforced parallel slits, which slits are located two each on each of the sides of the third mesh pocket and are utilized for strapping items to the outside of the third mesh pocket.

A plurality of three outer pockets are provided, which outer pockets attach one each to the plurality of three mesh pockets on the outer side of said plurality of three mesh pockets providing for a double pocket design. A first outer pocket attaches to the outer side of the first mesh pocket. A second outer pocket attaches to the outer side of the second mesh pocket. A third outer pocket attaches to the outer side of the third mesh pocket. The first outer pocket and second outer pocket respectively attach on the sides and bottom to the outer sides of the first mesh pocket and the second mesh pocket respectively, and each have a top opening. Inside each of the first outer pocket and the second outer pocket respectively, sewn to the outer side of the mesh of the first mesh pocket and the second mesh pocket, is a large shell attachment with six (6) shell loops in each attachment. The first mesh pocket and first outer pocket have a pocket flap, which pocket flap encloses the top opening of the first mesh pocket and the first outer pocket. The second mesh pocket and the second outer pocket have a pocket flap, which pocket flap encloses the top opening of the second mesh pocket and the second outer pocket. The pocket flaps each respectively have one half of a securing means, such as a snap, which corresponds with a complimentary one half of a securing means, such as a snap, attached to the outside of the first outer pocket and the second outer pocket respectively. In addition, the pocket flaps each respectively have one half of securing means, such as a hook and loop means, attached, which securing means, such as a hook and loop means, corresponds with a complimentary one half of a securing means, such as a hook and loop means, attached to the top of the first mesh pocket and the second mesh pocket such that when the securing means, such as a hook and loop means, are connected the first mesh pocket and the second mesh pocket are enclosed at the top.

The third outer pocket attaches to the outer side of the third mesh pocket on the top, sides and bottom, and provides for a top and side opening. The third outer pocket has a sealing means, such as a zipper, which extends along the sides and over the top of the third outer pocket and provides for access to the interior thereof vet providing for the complete enclosure of the third outer pocket.

An inner back pocket is provided in the back panel. The inner back pocket is formed between the outer side of the back panel and the liquid impervious material and is enclosed on the sides and bottom. The inner back pocket has a top opening which is sealed by sealing means, such as a zipper.

One half each of an adjustable securing strap is located respectively one each on the left side/front panel and the right side/front panel, which securing strap provides for securing the sportsman's vest around the torso of the wearer. The adjustable securing strap has a snap or other buckle type interconnecting means for securing the halves of adjustable securing strap together.

Adjustable suspenders are provided, which suspenders have two adjustable straps which go over the shoulders of the wearer and support the sportsman's vest on the torso of the wearer. The adjustable straps are attached to the top portion of the middle panel and extend therefrom one each toward the inside of the left side/front panel and the right side/front panel for attachment thereto. The adjustable straps each have a slide-type adjustment means located near said attachment to the top portion of the back panel, by which slide-type adjustment means each of said adjustable straps can be lengthened or shortened and thus adjusted to the wearer. Said slide-type adjustment means being located in such position are relatively out of the way and as such serve to prevent the same from inadvertently catching on a gun or other equipment being held in the front of the wearer's body.

The bottom bottle pocket is open therethrough on a horizontal plane across the bottom length of the bottom portion of the back panel when the sportsman's vest is being worn and provides sufficient space for the storage and carrying of bottles of water or other. The bottom bottle pocket has a left open end and a right open end, which open ends each have a drawstring assembly for enclosing the bottom bottle pocket. The bottom bottle pocket is separated on the top from the bottom of the third mesh pocket by mesh and thus open to the interior thereby. The liquid impervious material of bottom bottle pocket shields the back and pants of the wearer from any blood from any birds or other game being carried in the third mesh pocket.

There has thus been outlined, rather broadly, the more important features of the new and improved sportsman's vest of the present invention in order that the detailed description thereof that follows may be better understood, and in order that the present contribution to the art may be better appreciated. There are, of course, additional features of the new and improved sportsman's vest of the present invention that will be described hereinafter and which will form the subject matter of the claims appended hereto.

In this respect, before explaining at least one embodiment of the new and improved sportsman's vest of the present invention in detail, it is to be understood that the new and improved sportsman's vest of the present invention is not limited in its application to the details of construction and to the arrangements of the components set forth in the following description or illustrated in the drawings. The new and improved sportsman's vest of the present invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the new and improved sportsman's vest of the present invention. It is important, therefore, that the claims be regarded as including such equivalent construction insofar as they do not depart from the spirit and scope of the new and improved sportsman's vest of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection of the nature and essence of the technical disclosure of the application. The abstract is neither intended to define the invention of the application, which is measured by the claims, nor is it intended to be limiting as to the scope of the new and improved sportsman's vest of the present invention in any way.

It is therefore an object of the present invention to provide a new and improved sportsman's vest which has all of the advantages of the prior art and none of the disadvantages.

It is another object of the present invention to provide a new and improved sportsman's vest which may be easily and efficiently manufactured and marketed.

It is another object of the present invention to provide a new and improved sportsman's vest which is of a durable and reliable construction.

It is another object of the present invention to provide a new and improved sportsman's vest which is susceptible of a low cost of manufacture with regard to both material and labor and which accordingly is susceptible of low prices of sale to the consuming public, thereby making such a new and improved sportsman's vest economically available to the buying public.

It is another object of the present invention to render shooting sports more convenient and enjoyable by rendering the shooting apparel of greater convenience.

These together with other objects of the new and improved sportsman's vest of the present invention, along with the various features of novelty which characterize the new and improved sportsman's vest of the present invention, are pointed out with particularity in the claims annexed to and forming a part of this disclosure. For a better understanding of the new and improved sportsman's vest of the present invention, its operating advantages and the specific objects attained by its uses, reference should be had to the accompanying drawings and descriptive matter in which there is illustrated preferred embodiments of the new and improved sportsman's vest of the present invention.

BRIEF DESCRIPTION OF THE DRAWINGS

The new and improved sportsman's vest of the present invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
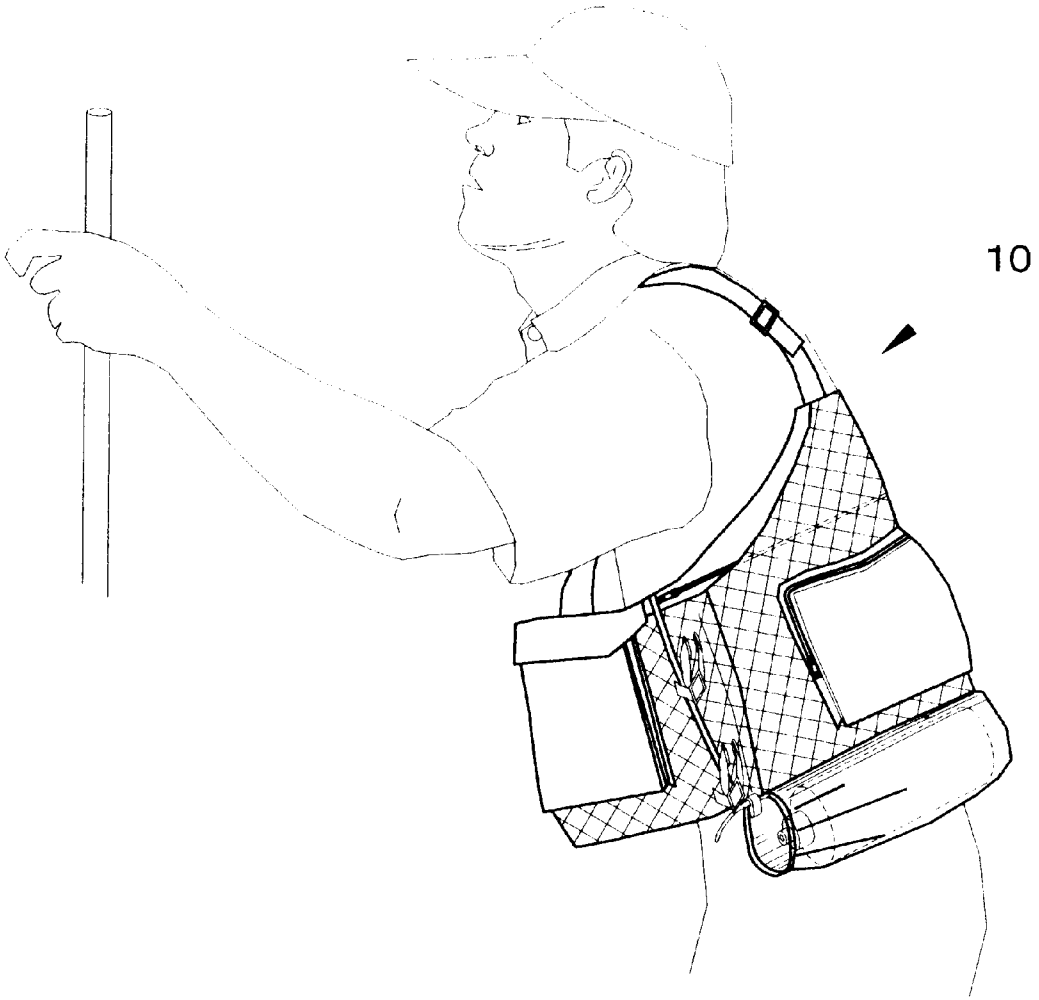
FIG. 1 is a perspective view of the sportsman's vest being worn showing the bottom bottle pocket, the mesh pockets and the outer pockets.
Figure 2:
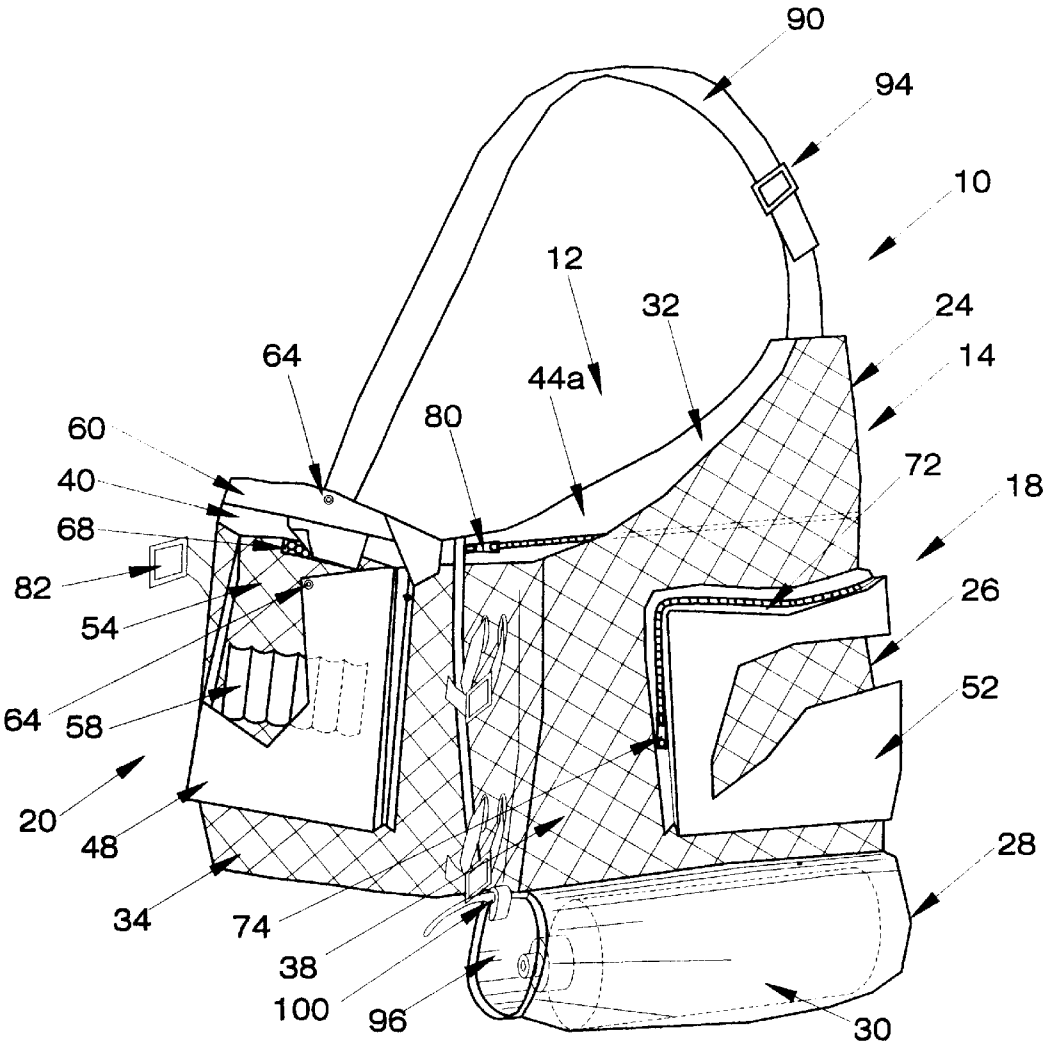
FIG. 2 is a left side perspective view of the sportsman's vest showing in greater detail the bottom bottle pocket, the mesh pockets and the outer pockets.
Figure 3:
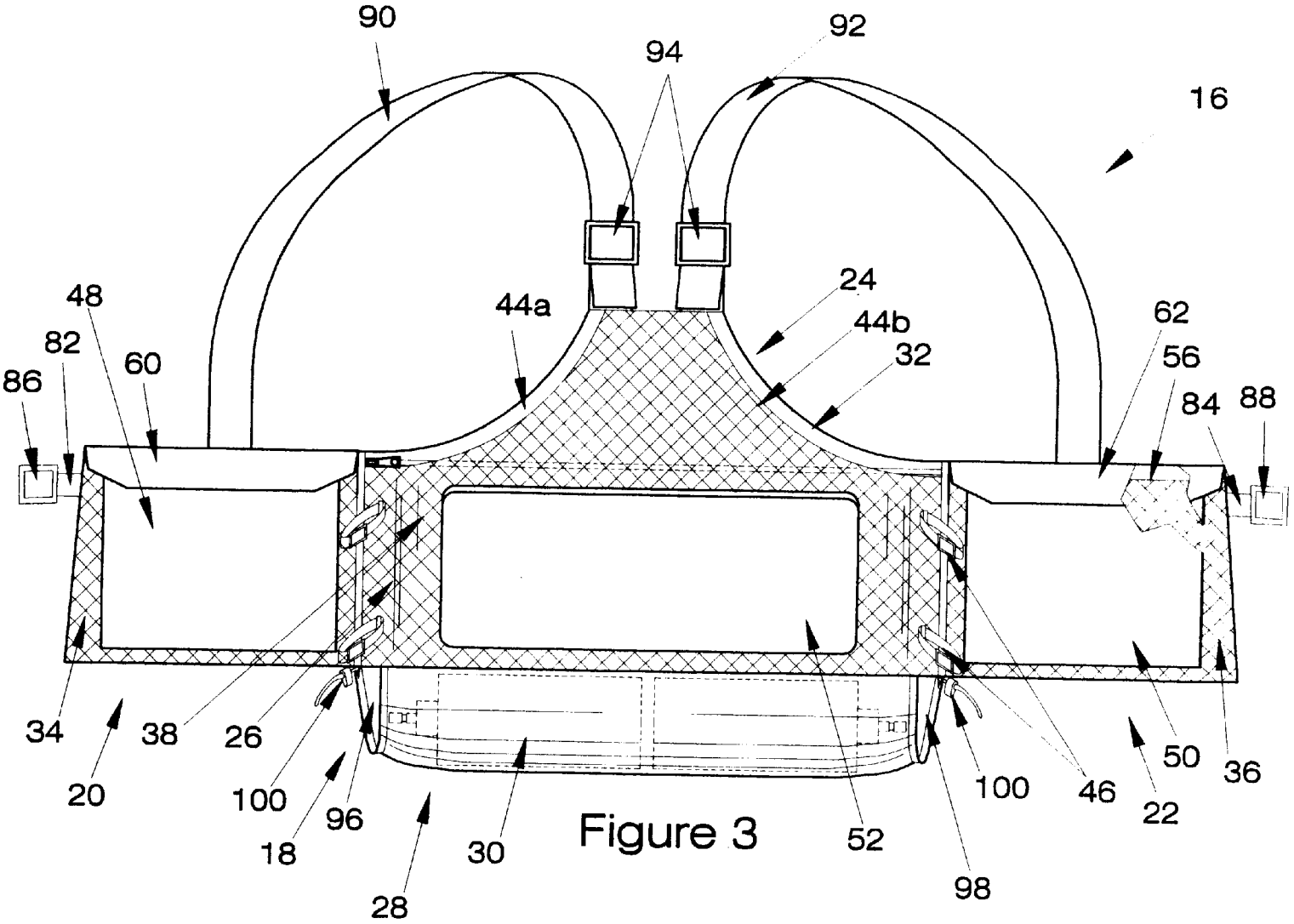
FIG. 3 is a view of the sportsman's vest shown flat with the inside of the sportsman's vest away from the viewer, showing in great detail the bottom bottle pocket, the mesh pockets, the outer pockets, the pocket flaps, the suspenders and the attachment straps.
Figure 4:
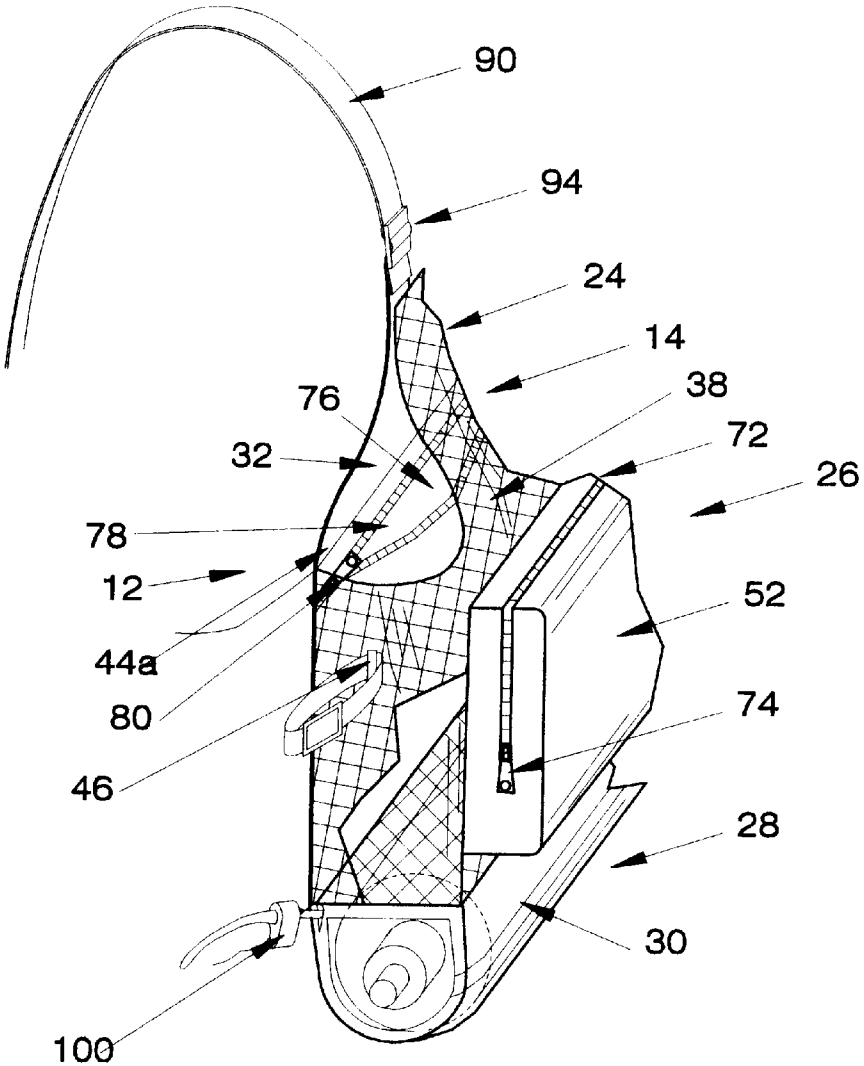
FIG. 4 is a left side cut away view of the sportsman's vest showing the bottom bottle pocket, the inner pocket, the mesh pocket on the back and the outer pocket on the back.

While the new and improved sportsman's vest of the present invention will be described more fully with reference to the accompanying drawings, in which particular embodiments are shown, it is to be understood at this outset that persons skilled in the art may modify the new and improved sportsman's vest of the present invention while still achieving the favorable results of the invention. Accordingly, the description which follows is to be understood as a broad teaching disclosure directed to persons of skill in the appropriate arts and not as limiting upon the new and improved sportsman's vest of the present invention.

With reference now to the drawings, and in particular to FIG. 1 through FIG. 4 thereof, a new and improved sportsman's vest embodying the principals and concepts of the present invention and generally designated by the reference numeral 10 will be described.

More specifically, it will be noted that, in FIG. 1, the invention relates to a new and improved sportsman's vest 10 particularly adapted for wear by shooters or other sports persons. The sportsman's vest 10 is designed and adapted to wrap around and be secured upon the upper torso of the wearer. The sportsman's vest 10 thus provides for an inner side 12 and an outer side 14 when the same is being worn. The sportsman's vest 10 includes a singular t-shaped piece 16 which is divided into a back panel 18, a left side/front panel 20, and a right side/front panel 22 (which left side/front panel 20 and right side/front panel 22 are relative to the front of the wearer when the sportsman's vest 10 is worn). The back panel 18 includes a top portion 24, a middle portion 26 and a bottom portion 28. The bottom portion 28 of the back panel 18 is folded and secured to provide a bottom bottle pocket 30. The singular t-shaped piece 16 may be crafted from any sturdy, flexible material, such as nylon but 1000 Denier CORDURA Reg. "U.S.Pat.&Tm.Off." nylon or similar strength material provide optimal results. The middle portion 26 and the bottom portion 28 of the back panel 18 are lined on the outer side 14 with material 32 which provides for liquid imperviousness thereof.

A plurality of three mesh pockets 34, 36, 38 are provided, said mesh being either knitted mesh material or woven mesh material. A first mesh pocket 34 is located on the outer side 14 of the left side/front panel 20. A second mesh pocket 36 is located on the outer side 14 of the right side/front panel 22. Pocket 34 is attached on two sides and the bottom of left side/front panel 20 and has a top opening 40. Pocket 36 is attached on two sides and the bottom of right side/front panel 22 and has a top opening 42. In another embodiment of the sportsman's vest 10, said pocket 34 and said pocket 36 may be made of non-mesh sturdy material.

A third mesh pocket 38 is located on the outer side 14 of the back panel 18 and attaches on the bottom to bottom bottle pocket 30 and on the top to top portion 24. The bottom of third mesh pocket 38 provides for a mesh top of bottom bottle pocket 30. Pocket 38 has a pair of top openings 44*a*, 44*b*, one each on each side of the attachment of pocket 38 to top portion 24, which top openings 44*a*, 44*b* provide for easy access into said pocket 38. Pocket 38 has a plurality of four reinforced parallel slits 46, which slits 46 are located two each on each of the sides of pocket 38 and are utilized for strapping items to the outside of pocket 38.

A plurality of three outer pockets 48, 50, 52 are provided, which outer pockets 48, 50, 52 attach one each to the plurality of three mesh pockets 34, 36, 38 on the outer side of said plurality of three mesh pockets 34, 36, 38 providing for a double pocket design. Pocket 48 attaches to the outer side of pocket 34. Pocket 50 attaches to the outer side of pocket 36. Pocket 52 attaches to the outer side of pocket 38. Pockets 48 and 50 respectively attach on the sides and bottom to the outer sides of mesh pockets 34 and 36 respectively, and have top openings 54 and 56. Inside each of pockets 48 and 50 respectively, sewn to the outer side of the mesh, is a large shell attachment 58 with six (6) shell loops in each attachment. Pockets 34 and 48 have a pocket flap 60, which pocket flap 60 encloses the top opening of pockets 34 and 48. Pockets 36 and 50 have a pocket flap 62, which pocket flap 62 encloses the top opening of pockets 36 and 50. Pocket flaps 60 and 62 each respectively have one half of a securing means 64, such as a snap, which corresponds with a complimentary one half of a securing means 66, such as a snap, attached to the outside of pockets 48 and 50 respectively, such that when the securing means 64, 66 are connected, pockets 48 and 50 are enclosed at the top. In addition, pocket flaps 60 and 62 each respectively have one half of securing means 68, such as a hook and loop means, attached, which securing means 68, such as a hook and loop means, corresponds with a complimentary one half of a securing means 70, such as a hook and loop means, attached to the top of pockets 34 and 36 such that when the securing means 68, 70, such as a hook and loop means, are connected pockets 34 and 36 are enclosed at the top.

Pocket 52 attaches to the outer side of mesh pocket 38 on the top, sides and bottom, and provides for a top and side opening 72. Pocket 52 has a sealing means 74, such as a zipper, which extends along the sides and over the top of pocket 52 and provides for access to the interior thereof yet providing for the complete enclosure of pocket 52.

An inner back pocket 76 is provided in back panel 18. The inner back pocket 76 is formed between the outer side 14 of back panel 18 and the liquid impervious material 32 and is enclosed on the sides and bottom. Inner back pocket 76 has a top opening 78, which top opening 78 is sealed by sealing means 80, such as a zipper.

One half each 82, 84 of an adjustable securing strap is located on the sportsman's vest 10, with 82 on the left side/front panel 20 and 84 on the right side/front panel 22, which adjustable securing strap provides for securing the sportsman's vest 10 around the torso of the wearer when the halves 82, 84 are secured together. Each half 82, 84 has one half 86, 88 of a snap, or other buckle type interconnecting means for securing the halves 82, 84 of the adjustable securing strap together.

Adjustable suspenders are provided, which adjustable suspenders have two adjustable straps 90, 92 which go over the shoulders of the wearer and support the sportsman's vest 10 on the torso of the wearer. The adjustable straps 90, 92 are attached to the top portion 24 of back panel 18 and extend therefrom with adjustable strap 90 toward the inner side 12 of the left side/front panel 20 and adjustable strap 92 toward the inner side 12 of the right side/front panel 22 for attachment thereto. The adjustable straps 90, 92 each have a slide-type adjustment means 94 located near said attachment to the top portion 24 of back panel 18, by which slide-type adjustment means 94 each of said adjustable straps 90, 92 can be lengthened or shortened and thus adjusted to the wearer. Said slide-type adjustment means 94 being located in such position are relatively out of the way and as such serve to prevent the same from inadvertently catching on a gun or other equipment being held in the front of the wearer's body.

The bottom bottle pocket 30 is open therethrough on a horizontal plane across the bottom length of the bottom portion 28 of back panel 18 when the sportsman's vest 10 is being worn and provides sufficient space for the storage and carrying of bottles of water or other. The bottom bottle pocket 30 has a left open end 96 and a right open end 98, which open ends 96, 98 each have a drawstring assembly 100 for enclosing the bottom bottle pocket 30. The bottom bottle pocket 30 is separated on the top from the bottom of third mesh pocket 38 by mesh and thus open to the interior thereby. The liquid impervious material 32 of bottom bottle pocket 30 shields the back and pants of the wearer from any blood from any birds or other game being carried in third mesh pocket 38.

As to the manner of usage and operation of the new and improved sportsman's vest 10 of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principals of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed and desired to be secured by United States Letters Patent is:

1. A sportsman's vest comprising, in combination:

a singular t-shaped piece having an inner side and an outer side, and having a back panel, a left side/front panel, and a right side/front panel;

said back panel having a top portion, a middle portion and a bottom portion;

said bottom portion of said back panel being folded and secured and providing for a bottom bottle pocket;

said middle portion and said bottom portion of said back panel being lined on said outer side with liquid impervious material;

a plurality of three mesh pockets being provided;

a first mesh pocket of said plurality of three mesh pockets being located on said outer side of said left side/front panel;

a second mesh pocket of said plurality of three mesh pockets being located on said outer side of said right side/front panel;

said first mesh pocket being attached on two sides and bottom of said left side/front panel and having a top opening;

said second mesh pocket being attached on two sides and bottom of right side/front panel and having a top opening;

a third mesh pocket of said plurality of three mesh pockets being located on said outer side of said middle portion of said back panel and attaching to said bottom bottle pocket and to said top portion;

a bottom of said third mesh pocket providing for a mesh top of said bottom bottle pocket;

said third mesh pocket having a pair of top openings, said pair of top openings being one each on each side of the attachment of said third mesh pocket to said top portion, said pair of top openings providing for easy access into said third mesh pocket;

said third mesh pocket having a plurality of four reinforced parallel slits, said plurality of four reinforced parallel slits being located two each on each of the sides of said third mesh pocket;

a plurality of three outer pockets being provided, said plurality of three outer pockets attaching one each to one each of said plurality of three mesh pockets on the outer side of said plurality of three mesh pockets, thus providing for a double pocket design;

a first outer pocket of said plurality of three outer pockets attaching to the outer side of said first mesh pocket;

a second outer pocket of said plurality of three outer pockets attaching to the outer side of said second mesh pocket;

a third outer pocket of said plurality of three outer pockets attaching to the outer side of said third mesh pocket;

said first outer pocket and said second outer pocket respectively attaching on sides and bottom to the outer side of said first mesh pocket and said second mesh pocket respectively;

said first outer pocket and said second outer pocket each having a top opening;

said first outer pocket and said second outer pocket each having a large shell attachment, said large shell attachments being sewn to the outer side of said first mesh pocket and said second mesh pocket respectively;

said first mesh pocket and said first outer pocket having a pocket flap, said pocket flap enclosing the top opening of said first mesh pocket and said first outer pocket;

said second mesh pocket and said second outer pocket having a pocket flap, said pocket flap enclosing the top opening of said second mesh pocket and said second outer pocket;

said pocket flaps each respectively having one half of a securing means, said securing means corresponding with a complimentary one half of a securing means attaching to the outside of said first outer pocket and said second outer pocket respectively;

said pocket flaps further each respectively having one half of securing means, said securing means corresponding with a complimentary one half of a securing means attaching to the top of said first mesh pocket and said second mesh pocket such that when said securing means are connecting said first mesh pocket and said second mesh pocket are enclosed at the top;

said third outer pocket attaching to the outer side of said third mesh pocket on top, sides and bottom, and providing for a top and side opening;

said third outer pocket having a sealing means, said sealing means extending along the sides and over the top of said third outer pocket and providing for access to the interior said third outer pocket;

an inner back pocket being provided in said back panel;

said inner back pocket being formed between the outer side of said back panel and said liquid impervious material and being enclosed on sides and bottom;

said inner back pocket having a top opening, said top opening being sealed by sealing means;

an adjustable securing strap being provided, with one half each of said adjustable securing strap being located respectively one each on said left side/front panel and said right side/front panel;

said adjustable securing strap having a snap interconnecting means for securing said halves of said adjustable securing strap together;

a pair of adjustable suspenders being provided, said pair of adjustable suspenders having two adjustable straps which go over the shoulders of the wearer and support said sportsman's vest;

said two adjustable straps being attached to said top portion of said middle panel and extending therefrom one each toward the inside of said left side/front panel and said right side/front panel for attaching thereto;

said two adjustable straps each having a slide-type adjustment means, said slide-type adjustment means being located near said attachment to said top portion of said back panel and providing for said adjustable straps being lengthened or shortened and thus adjusted;

said bottom bottle pocket being open therethrough on a horizontal plane across a bottom length of said bottom portion of said back panel and providing space for storage and carrying of bottles;

said bottom bottle pocket having a left open end and a right open end, said left open end and said right open end each having a drawstring assembly for enclosing said left open end and said right open end of said bottom bottle pocket; and, said bottom bottle pocket being separated on top from the bottom of said third mesh pocket by mesh and thus opening into the interior said third mesh pocket.

2. The sportsman's vest of claim 1, wherein said mesh pockets further comprise knitted mesh material.

3. The sportsman's vest of claim 1, wherein said mesh pockets further comprise woven mesh material.

4. The sportsman's vest of claim 1, wherein said singular t-shaped piece further comprises nylon.

5. The sportsman's vest of claim 1, wherein said pocket flaps further comprise each respectively having one half of a snap, said one half of a snap corresponding with a complimentary one half of a snap being attached to the outside said first outer pocket and said second outer pocket respectively.

6. The sportsman's vest of claim 1, wherein said pocket flaps further comprise each respectively having one half of a hook and loop means attached, said one half of a hook and loop means corresponding with a complimentary one half of a hook and loop means being attached to the top of said first mesh pocket and said second mesh pocket respectively.

7. The sportsman's vest of claim 1, wherein said third outer pocket further comprises having a zipper, said zipper extending along the sides and over the top of said third outer pocket.

8. The sportsman's vest of claim 1, wherein said inner back pocket further comprises having a top opening, said top opening being sealed by means of a zipper.

9. The sportsman's vest of claim 1, wherein said adjustable securing strap further comprises having a buckle type interconnecting means for securing the same.

10. The sportsman's vest of claim 1, wherein said first mesh pocket and said second mesh pocket further comprise sturdy material.

* * * * *